US010294628B1

(12) United States Patent
Childress

(10) Patent No.: US 10,294,628 B1
(45) Date of Patent: May 21, 2019

(54) SYSTEMS AND METHODS FOR LIFTED FOUNDATION RETENTION WITH LOCKING CAP

(71) Applicant: Tella Firma Foundations, Richardson, TX (US)

(72) Inventor: Tony H. Childress, Plano, TX (US)

(73) Assignee: Tella Firma, LLC, Richardson, TX (US)

( * ) Notice: Subject to any disclaimer, the term of this patent is extended or adjusted under 35 U.S.C. 154(b) by 0 days.

(21) Appl. No.: 15/936,020

(22) Filed: Mar. 26, 2018

(51) Int. Cl.
*E02D 27/34* (2006.01)
*E02D 35/00* (2006.01)
*E04G 23/06* (2006.01)

(52) U.S. Cl.
CPC ..... *E02D 35/005* (2013.01); *E02D 27/34* (2013.01); *E04G 23/065* (2013.01)

(58) Field of Classification Search
CPC ..... E02D 35/005; E02D 27/34; E04G 23/065
See application file for complete search history.

(56) References Cited

U.S. PATENT DOCUMENTS 4,507,069 A * 3/1985 Murray ..... E02D 3/12 264/33
4,591,466 A * 5/1986 Murray ..... E02D 3/12 264/35
4,938,633 A * 7/1990 Wu ..... E02D 27/34 376/285
6,722,821 B1 4/2004 Perko et al.
6,923,599 B2 8/2005 Kelso
7,823,341 B2 11/2010 Kelly et al.
8,069,620 B2 12/2011 Kelly et al.
8,407,898 B2 4/2013 Marshall
8,458,984 B2 6/2013 Marshall
8,671,627 B2 3/2014 Marshall
8,678,712 B2 3/2014 Marshall
2007/0028557 A1 * 2/2007 Kelly ..... E02D 27/34 52/741.15

(Continued)

FOREIGN PATENT DOCUMENTS

CA 2628422 A1 2/2007

*Primary Examiner* — Rodney Mintz
(74) *Attorney, Agent, or Firm* — Norton Rose Fulbright US LLP

(57) ABSTRACT

Systems and methods which provide for lifted foundation retention using foundation lift retainer assemblies having a locking cap configuration are described. A locking cap foundation retention system of embodiments may include a foundation lift interface assembly supporting operations to lift a foundation and a foundation lift retainer assembly having a locking cap configuration utilized in sustaining the foundation in a lifted position. A locking cap of embodiments is configured to accommodate operation of a removable lift mechanism lifting a foundation and thereafter for sustaining the foundation in the lifted position. A foundation lift interface may be configured to allow a foundation to move with respect to components of a foundation lift retainer assembly during a foundation lifting operation, whereby the locking cap of the foundation lift retainer assembly engages one or more components of the foundation lift interface to restrict movement of the foundation subsequent to the foundation lifting operation.

29 Claims, 7 Drawing Sheets

(56) References Cited

U.S. PATENT DOCUMENTS

| | | | | |
|---|---|---|---|---|
| 2008/0236061 | A1* | 10/2008 | Hickman | E02D 35/00 52/125.1 |
| 2008/0304919 | A1* | 12/2008 | Coyle | E02D 27/02 405/250 |
| 2011/0020068 | A1* | 1/2011 | Kelly | E02D 27/34 405/230 |
| 2011/0023384 | A1* | 2/2011 | Marshall | E02D 27/32 52/125.1 |
| 2011/0116873 | A1* | 5/2011 | Marshall | E02D 35/00 405/230 |
| 2012/0114423 | A1* | 5/2012 | Zago | E02D 35/00 405/230 |
| 2012/0288335 | A1 | 11/2012 | Green | |

* cited by examiner

SYSTEMS AND METHODS FOR LIFTED FOUNDATION RETENTION WITH LOCKING CAP

CROSS-REFERENCE TO RELATED APPLICATIONS

The present application is related to co-pending and commonly assigned U.S. patent application Ser. No. 15/902,774 entitled "SYSTEMS AND METHODS FOR PREVENTING LATERAL SOIL MIGRATION INTO A VOID SPACE OF A LIFTED FOUNDATION" filed Feb. 22, 2018, the disclosure of which is hereby incorporated herein by reference.

TECHNICAL FIELD

The present application relates to foundation lifting and, more specifically, to foundation lifting systems and methods using a foundation lift retainer assembly having a locking cap configuration for sustaining a foundation in a lifted position.

BACKGROUND OF THE INVENTION

The quality of a structure, whether it is a house, apartment building, or commercial building, is inextricably tied to its foundation. If the structure is not built on a proper foundation, the rest of the structure, even if properly constructed, is likely to show defects over time. When foundations are constructed directly on ground soils, it often creates an unstable environment for the foundation. In addition, if these soils are active or expansive, the environment may be especially problematic. For example, in regions where the soil has a high percentage of active clay, expansion and contraction of the clay subjects the foundations to significant loads (e.g., forces) and potential movement.

Structures built on soils in certain regions may have had their slab foundations and walls displaced and damaged (e.g., cracked foundations and walls) as a result of differential expansion and/or contraction of the soil. Over time, engineers have developed systems and methods for designing foundations in an attempt to minimize damage due to soil movement. Some of these systems and methods include isolating heavy slab foundations from the active soils by suspending the slab above the ground using structural supports (e.g., helical piers, drilled shaft piers, pressed concrete or steel pilings, spread footings, natural rock, etc.) and lifting assemblies (e.g., lifting bolts, hydraulic jacks, air-inflatable jacks, electrical scissor jacks, etc.). For example, U.S. Pat. No. 7,823,341, HEIGHT-ADJUST ABLE, STRUCTURALLY SUSPENDED SLABS FOR A STRUCTURAL FOUNDATION, issued on Nov. 2, 2010, which is incorporated by reference herein, discloses a method of lifting a slab foundation using structural supports and lifting assemblies. The installation of supports and lifts to raise the slab foundation creates a protective void between the soil and the slab foundation, such as may permit the vertical expansion of the soil without subjecting the slab foundation to varying forces associated with the dynamic nature of soil.

Many of the existing systems and methods for providing a slab foundation suspended over the ground surface require the foundation to be formed in the final suspended position, and thus often require relatively expensive concrete forming materials (e.g., void material, such as waterproofed honeycombed box structures, sacrificed in the area between the ground surface and a poured concrete slab foundation) and may prevent the typically more labor efficient foundation construction techniques used in forming slab foundations on the ground surface. Existing systems and methods for lifting heavy slab foundations after their being formed on the ground surface to isolate the foundation from active soils are often relatively costly with respect to the materials consumed by the process (e.g., the components, such as lifting mechanisms and associated components, that remain to hold the foundation in its lifted position) and labor intensive to implement (e.g., requiring an appreciable number of workers to manually manipulate tens to over one hundred lifting mechanisms distributed throughout a slab foundation).

BRIEF SUMMARY OF THE INVENTION

The present invention is directed to systems and methods which provide for foundation lifting and retention using foundation lift retainer assemblies having a locking cap configuration. A locking cap foundation retention system of embodiments of the present invention may, for example, include a foundation lift interface assembly utilized in lifting a foundation structure and a foundation lift retainer assembly having a locking cap configuration in accordance with the concepts herein utilized in sustaining the foundation structure in the lifted position.

A foundation lift retainer assembly of embodiments of a locking cap foundation retention system includes a locking cap configured to accommodate operation of a removable lift mechanism, such as a hydraulic ram, lifting a foundation and thereafter for sustaining the foundation in the lifted position after removal of the lift mechanism. For example, a locking cap of a foundation retainer assembly may interface with one or more components of a foundation lift interface, such as may be embedded in or otherwise engaged with a foundation structure, for sustaining the foundation in a lifted position. In accordance with embodiments of the invention, a foundation lift interface is configured to allow a foundation structure to move with respect to one or more components (e.g., a lift support member) of a foundation lift retainer assembly during a foundation lifting operation, whereby the locking cap of the foundation lift retainer assembly engages one or more components (e.g., a lifting puck) of the foundation lift interface to restrict movement of the foundation subsequent to the foundation lifting operation, thereby sustain the foundation in a lifted position.

Foundation retention apparatuses using locking cap configurations according to embodiments of the invention provide for sustaining a foundation in a lifted position relatively inexpensively in terms of the materials consumed by the process. For example, the components of the foundation lift interface (e.g., lift pull member and lifting puck) and the foundation lift retainer (e.g., locking cap and lift support member) that remain to hold the foundation in its lifted position for each instance of a foundation lift point may comprise reasonably simple to manufacture components formed from relatively little and inexpensive material (e.g., steel pipe and plates machined to provide functionality in accordance with concepts herein). Moreover, the removable lifting mechanisms and the lifting and retention operations utilized with respect to embodiments of a locking cap foundation retention system facilitate efficient use of labor (e.g., allowing only a few, or even one or two, workers to perform the lifting and retention operations for a slab foundation).

Additionally, embodiments of locking cap foundation retention systems can accommodate various lift heights and adjustments. For example, foundation lift retainer assemblies may be configured for different lift heights (e.g., ranging from inches to multiple feet) through selection of appropriate longitudinal lengths and/or lateral dimensions (e.g., diameter, area, shape, etc.) of the lift support members. Fine adjustment of lift height (e.g., amounts of a few inches or less, such as depending upon the thickness of the locking cap and/or lifting puck utilized) may be provided through manipulation of the engagement of a locking cap of the foundation lift retainer assembly with the foundation lift interface assembly. Accordingly, embodiments of a locking cap foundation retention system provide a highly versatile and cost effective means by which foundation structures, such as poured concrete slab foundations, lifted using removable lifting mechanisms may be indefinitely sustained in a lifted position.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1:
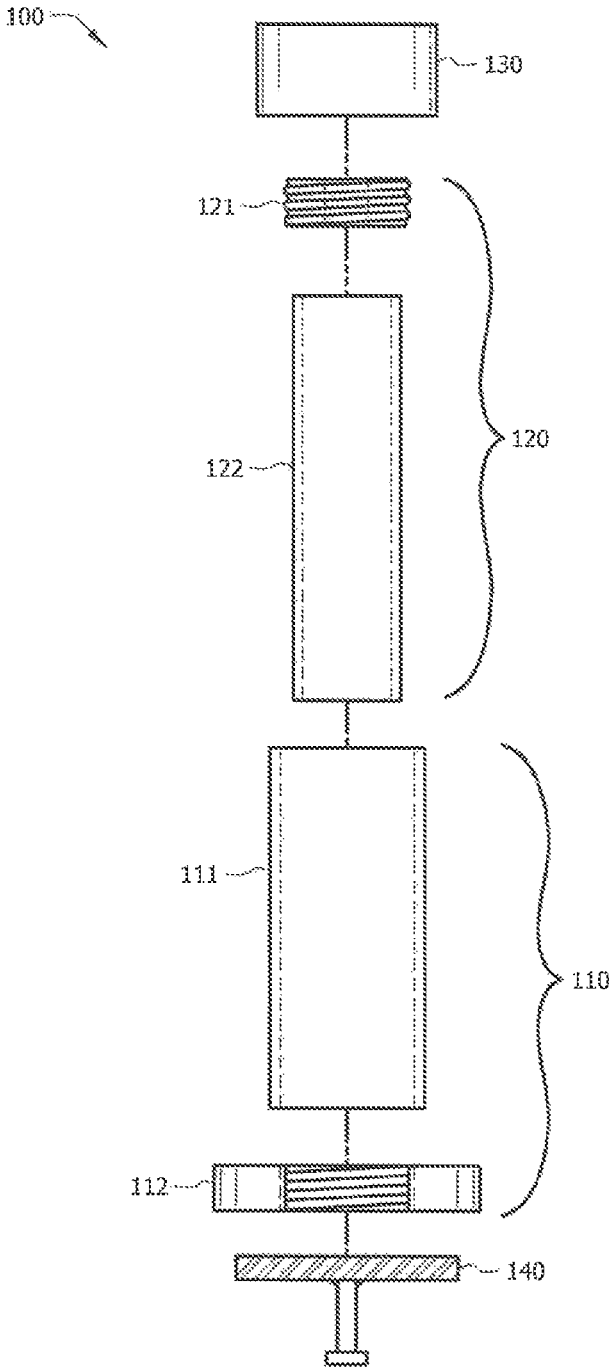
FIG. 1 shows an exploded view of a locking cap foundation retention system of embodiments of the present invention.

FIG. 1 shows an exploded view of embodiments of a locking cap foundation retention system in accordance with concepts of the present invention. Locking cap foundation retention system 100 of the illustrated embodiment is configured to support foundation lifting using removable lifting mechanisms and provide retention of lifted foundations using foundation lift retainer assemblies having a locking cap configuration. Accordingly, locking cap foundation retention system 100 shown in FIG. 1 includes foundation lift interface assembly 110 utilized in combination with removable lifting mechanisms to raise a foundation structure to a lifted position and foundation lift retainer assembly 120, having a locking cap configuration in accordance with the concepts herein, utilized in sustaining the foundation structure in the lifted position.

Figure 2A:
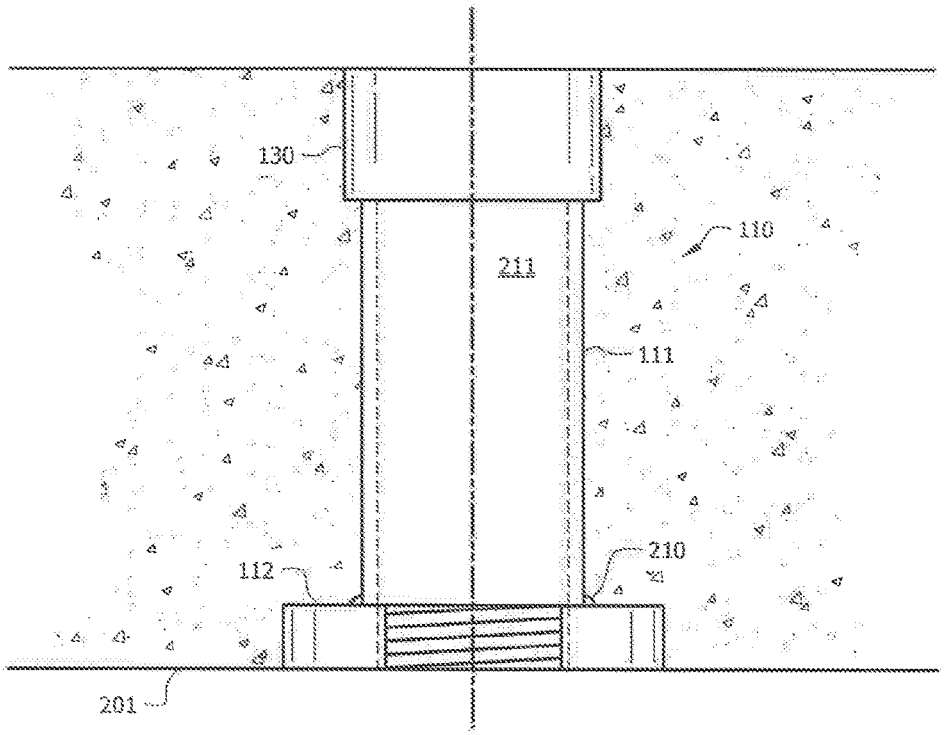
FIGS. 2A and 2B show details of components of a foundation lift interface assembly of a locking cap foundation retention system of embodiments of the present invention.

Foundation lift interface assembly 110 of the illustrated embodiment of locking cap foundation retention system 100 includes lift pull member 111 and lifting puck 112. In accordance with embodiments of the invention, the components of foundation lift interface assembly 110 are configured to be embedded in or otherwise engaged with a foundation structure and to cooperate with a removable lifting mechanism to raise the foundation structure to a lifted position and with components of foundation lift retainer assembly 120 in retaining the foundation structure in the lifted position. FIG. 2A shows an example of foundation lift interface assembly 110 embedded in foundation structure 201, such as may comprise poured concrete.

Lift pull member 111 may, for example, comprise a length of pipe (e.g., schedule 40 steel pipe) or other structure having an appropriate opening, orifice, or other configuration of passageway (referred to herein as a lumen) therethrough and configured (e.g., sized) to extend, or substantially extend, through the media (e.g., poured concrete) of a foundation structure along an axis of intended lifting. In accordance with embodiments of the invention, the longitudinal length of lift pull member 111 is selected to correspond to a foundation structure thickness at a position at which the lift pull member is to be disposed. For example, the longitudinal length of lift pull member 111 may be selected such that, when combined with a thickness of one or more other components (e.g., lifting puck 112) of foundation lift interface assembly 110, the combined structure will extend, or substantially extend, through the foundation structure. In the example of FIG. 2A, wherein the combined structure substantially extends through foundation structure 201, the length of lift pull member 111, thickness of lifting puck 112, and thickness of plug 130 combine to be the thickness of foundation structure 201 at a position at which the foundation lift interface assembly is disposed (e.g., where foundation structure 201 is 10 inches thick, the length of lift pull member 111 may be 7 inches, the thickness of lifting puck 112 may be 1 inch, and the thickness of plug 130 may be 2 inches). A foundation media fill pocket is defined at an end of lift pull member 111 (e.g., at a foundation top surface) using plug 130 in the example of FIG. 2A. In particular, plug 130, such as may be formed from foam or other material suitable for displacing foundation media (e.g., poured concrete) of foundation structure 201, may be disposed over the end of lift pull member 111 when the foundation structure is formed (e.g., concrete is poured), and removed thereafter to reveal a foundation media fill pocket allowing access to the lift pull member and the lumen thereof during a lifting operation. After the lifting operation and engaging the locking cap of foundation lift retainer assembly 120 is complete, the foundation media fill pocket may be filled with foundation media or other material to conceal the components of locking cap foundation retention system 100. Lift pull member 111 of embodiments may include interfaces (e.g., latches, recess, slots, etc.) configured to accommodate attachment and removal of one or more lifting mechanism components (e.g., hooks, drawbars, etc.) during a lifting operation. For example, U.S. Pat. No. 8,671,627, SYSTEM FOR FORMING A MOVEABLE SLAB FOUNDATION, issued on Mar. 18, 2014, which is incorporated by reference herein, discloses a method for lifting a slab foundation using removable lifting mechanism with attachment components for interfacing with a lifting support sleeve embedded in a slab foundation and lifting rods for applying lifting forces to raise a slab foundation.

Lumen 211 (FIG. 2A) of lift pull member 111 of embodiments is configured (e.g., sized, shaped, etc.) to accommodate passage of locking cap 121 and lift support member 122 of foundation lift retainer assembly 120 during a lifting operation, as will be better understood from the discussion that follows. For example, a diameter of lumen 211 (e.g., inside diameter of lift pull member 11) is greater than an outside diameter of locking cap 121 and lift support member 122 of embodiments. Additionally, lift pull member 111 of embodiments is configured (e.g., sized, shaped, configured with attachment points, etc.) to transfer a lifting force (e.g., pull force) from a lifting mechanism (e.g., hydraulic actuator) to the foundation structure, also as will be better understood from the discussion that follows. For example, a diameter of lumen 211 of embodiments may be sufficiently greater than an outside diameter of locking cap 121 and lift support member 122 to accommodate attachment and removal of one or more lifting mechanism attachment components (e.g., hooks, drawbars, etc.) and the passage of locking cap 121 and lift support member 122 of foundation lift retainer assembly 120 during a lifting operation.

Figure 2B:
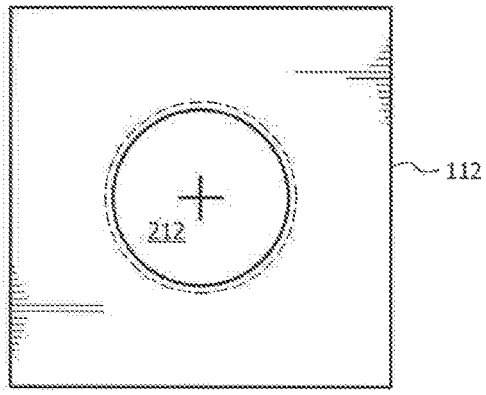

As shown in FIGS. 2A and 2B, lifting puck 112 of embodiments of foundation lift interface assembly 110 may comprise a plate (e.g., steel plate) or other structure having appropriate dimensions (e.g., size, shape, thickness, etc.) to provide support to the foundation structure while accommodating the lumen of lift pull member 111 disposed through the foundation structure. Lifting puck 112 of embodiments is further configured to aid in the retention of lift pull member 111 within a foundation structure during lifting operations. For example, lifting puck 112 may be sized and/or shaped to engage portions of the foundation media such that, when lifting puck 112 and lift pull member 111 are fixedly attached (e.g., by welding, use of appropriate fasteners, such as bolts, screws, high strength adhesives, etc., shown as fastener 210 in FIG. 2A), lifting puck 112 discourages migration of lift pull member 111 within the foundation structure from lifting forces. In accordance with embodiments of the invention, lifting puck 112 is configured with lateral dimensions (e.g., diameter or length and width) larger than an outside diameter of lift pull member 111 to both aid in the retention of lift pull member 111 within a foundation structure during lifting operations and provide support to the foundation structure when lifted.

Lifting puck 112 of the illustrated embodiment of foundation lift interface assembly 110 is configured to interface with one or more components of foundation lift retainer assembly 120. For example, lifting puck 112 includes lumen 212 (FIG. 2B) therethrough. Lumen 212 of lifting puck 112 of embodiments is configured (e.g., sized, shaped, etc.) to accommodate passage of lift support member 122 of foundation lift retainer assembly 120 during a lifting operation, as will be better understood from the discussion that follows. For example, a diameter of lumen 212 (e.g., inside diameter of lifting puck 112) is greater than an outside diameter of lift support member 122 of embodiments. Lumen 212 of lifting puck 112 of embodiments is further configured to engage locking cap 121. For example, although lumen 212 is configured to accommodate passage of lift support member 122, lumen 212 of embodiments has a diameter corresponding to an outside diameter of locking cap 121, wherein corresponding threads, cam-lock tabs, etc. of the lifting puck lumen and locking cap may nest to engage lifting puck 112 and locking cap 121. As a specific example, lifting puck 112 may have rope threads cut in lumen 212 for adjustably engaging locking cap 121 with sufficient strength to facilitate supporting a foundation via foundation lift retainer assembly 120.

Referring again to FIG. 1, foundation lift retainer assembly 120 of the illustrated embodiment of locking cap foundation retention system 100 includes locking cap 121 and lift support member 122. In accordance with embodiments of the invention, the components of foundation lift retainer assembly 120 are configured to cooperate with a removable lifting mechanism in raising a foundation structure to a lifted position and with components of foundation lift interface assembly 110 in retaining the foundation structure in the lifted position.

Lift support member 122 may, for example, comprise a length of pipe (e.g., schedule 40 steel pipe) or other structure configured (e.g., sized) to pass through lumen 211 of lift pull member 111 and lumen 212 of lifting puck 112. In accordance with embodiments of the invention, the longitudinal length of lift support member 122 is selected to correspond to an amount of lift to be provided with respect to a foundation structure. For example, the longitudinal length of lift support member 122 may be selected such that, when lift support member 122 rests on a subjacent support (e.g., baseplate 140) and locking cap 121 engages lifting puck 112, a desired amount of lift is provided for a foundation structure (e.g., a void is maintained between a bottom surface of the foundation structure and a ground surface upon which the foundation structure was formed).

Figure 3A:
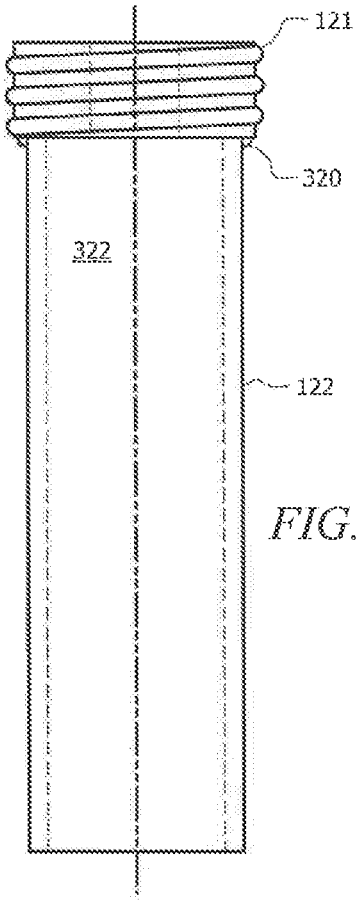
FIGS. 3A-3C show details of components of a foundation lift retainer assembly of a locking cap foundation retention system of embodiments of the present invention.
Figure 3B:
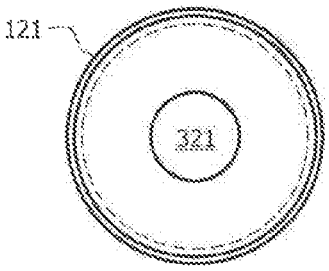
Figure 3C:
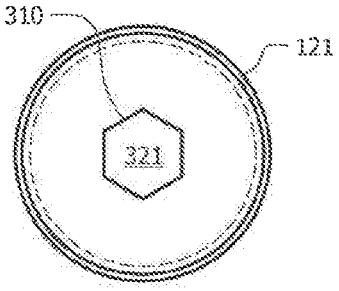

Locking cap 121 is configured (e.g., sized, shaped, etc.) for passage through lumen 211 of lift pull member 111 during a lifting operation. Moreover, locking cap 121 of embodiments is configured to cooperate with lift support member 122 and one or more components of foundation lift interface assembly 110 to facilitate supporting a foundation. For example, as shown in FIG. 3A, a diameter of locking cap 121 is greater than an outside diameter of lift support member 122 of embodiments. Accordingly, although lumen 212 of lifting puck 112 may accommodate passage of lift support member 122, locking cap 121 may engage lifting puck 112 after passage of lift support member 122 through lumen 212 and prevent lift support member 122 from passing back through lumen 211, thus providing a surface for supporting a foundation via lift support member 122. For example, after a lifting operation and engagement of locking cap 121 with lifting puck 112, lift support member 122 may rest on a top surface of a subjacent support (e.g., baseplate 140) and against a bottom surface of locking cap 121 to thereby hold a foundation in a lifted position.

As can be appreciated from the foregoing, locking cap 121 of embodiments is configured to interface with one or more components of foundation lift interface assembly 110. For example, locking cap 121 of the embodiment illustrated in FIGS. 1 and 3A-3C is configured to engage lifting puck 112. In particular, locking cap 121 of the illustrated embodiment has a diameter corresponding to a diameter of lumen 212 of lifting puck 112, wherein corresponding threads, cam-lock tabs, etc. of the lifting puck lumen and locking cap may nest to engage lifting puck 112 and locking cap 121. As set forth in the specific example above, locking cap 121 may have rope threads cut in a circumferential surface thereof for adjustably engaging lifting puck 112 with sufficient strength to facilitate supporting a foundation via foundation lift support member 122.

Locking cap 121 of embodiments may be configured with one or more locking feature, such as locking feature 310 (FIG. 3C), to facilitate engaging lifting puck 112. For example, locking feature 310 may provide one or more surface for applying rotational or torque forces to locking cap 121 for encouraging corresponding threads, cam-lock tabs, etc. of locking cap 121 and lifting puck 112 to engage. Although the embodiment of locking feature 310 illustrated in FIG. 3C comprises hex socket surfaces (e.g., to receive a correspondingly sized hex key) recessed into a surface of locking cap 121 (e.g., comprising the sidewalls of lumen 321), additional or alternative configurations of locking features may be utilized, such as a hex nut structure or finger twist structure extending from a surface of locking cap 121.

As described above, locking cap 121 of embodiments is configured to function in cooperation with lift support member 122 to support foundation by preventing lift support member 122 from passing back through lumen 211 after a lifting operation. Accordingly, locking cap 121 provides a surface for supporting the foundation via lift support member 122. In order to encourage proper centering of lift support member 122 on the surface of locking cap 121 and/or to discourage movement of lift support member 122 relative to locking cap 121, locking cap 121 and lift support member 122 of embodiments may be fixedly attached (e.g., by welding, use of appropriate fasteners, such as bolts, screws, high strength adhesives, etc., shown as fastener 320 in FIG. 3A).

Foundation lift retainer assembly 120 of embodiments of the invention is configured to accommodate operation of a removable lift mechanism, such as a hydraulic ram, lifting a foundation structure and thereafter for sustaining the foundation structure in the lifted position after removal of the lift mechanism. Accordingly, locking cap 121 and lift support member 122 of embodiments herein are configured to allow a foundation structure to move with respect to components (e.g., locking cap 121 and lift support member 122) of foundation lift retainer assembly 120 during a foundation lifting operation. For example, lumen 321 (FIGS. 3B and 3C) of locking cap 121 and lumen 322 of lift support member 122 of embodiments are configured (e.g., sized, shaped, etc.) to accommodate passage of a lifting ram (e.g., a ram of a hydraulic actuator used as a lifting mechanism) during a lifting operation, as will be better understood from the discussion that follows. For example, a diameter of lumen 321 (e.g., inside diameter of locking cap 121) of embodiments is greater than an outside diameter of a lifting ram (not shown). Likewise, a diameter of lumen 322 (e.g., inside diameter of lift support member 122) of embodiments is greater than an outside diameter of the lifting ram. Accordingly, during a lifting operation, a rain of a lifting mechanism may pass through locking cap 121 and lift support member 122, such as to engage a subjacent support (e.g., baseplate 140) for applying a lifting force for lifting a foundation. Moreover, lumen 321 and/or lumen 322 are configured (e.g., sized, shaped, etc.) to facilitate manipulation of locking cap 121 to engage lifting puck 112 (e.g., threading of locking cap 121 into lifting puck 112).

Figure 4A:
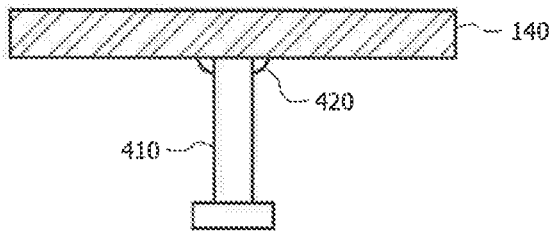
FIGS. 4A and 4B shows details of a baseplate component as may be utilized by a locking cap foundation retention system of embodiments of the present invention.
Figure 4B:
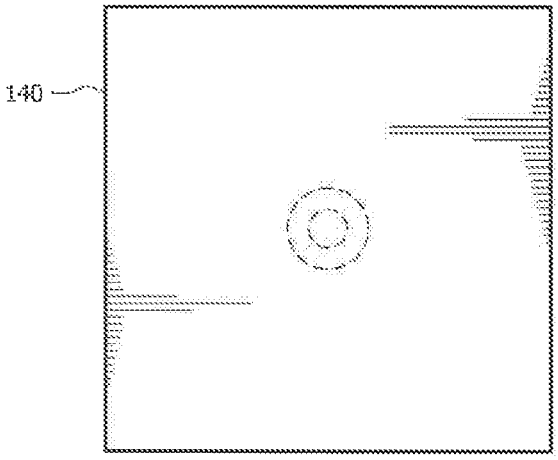

Various forms of subjacent support may be utilized in association with foundation lift retainer assembly 120 of embodiments of locking cap foundation retention system 100, provided sufficient stability and resistance to migration of lift support member 122 is provided. Embodiments of the present invention may, for example, utilize baseplate 140 in providing suitable subjacent support for instances of locking cap foundation retention system 100. As shown in FIGS. 4A and 4B, baseplate 140 may comprise a plate (e.g., steel plate) or other structure having appropriate dimensions (e.g., size, shape, thickness, etc.) to resist a lifting force of a lifting ram in a lifting operation and/or to provide support to lift support member 122 for sustaining the foundation structure in a lifted position.

Baseplate 140 of the illustrated embodiment is configured for stabilized attachment in a subjacent support structure. For example, baseplate 140 includes stud 410 (e.g., a Nelson stud) fixedly attached (e.g., by welding, use of appropriate fasteners, such as bolts, screws, high strength adhesives, etc., shown as fastener 420 in FIG. 4A) for facilitating attachment to a subjacent support structure, such as embedding within the media (e.g., poured concrete) of a piling or pier. Baseplate 140 of embodiments may additionally or alternatively be utilized with respect to other subjacent support structure, such as helical piers, drilled shaft piers, pressed concrete or steel pilings, spread footings, natural rock, etc. Moreover, various subjacent support structure, such as the aforementioned helical piers, drilled shaft piers, pressed concrete or steel pilings, spread footings, natural rock, etc., may be utilized without baseplate 140 in providing suitable subjacent support for instances of locking cap foundation retention system 100 of embodiments of the invention.

Having described components of locking cap foundation retention system 100 of embodiments of the invention in detail above, operation of locking cap foundation retention system 100 in a lifting operation and thereafter holding a foundation in a lifted position will be described to aid in understanding concepts of the present invention. In particular, the exemplary lifting and retaining process of FIG. 5 will be described with reference to the views of locking cap foundation retention system 100 shown in FIGS. 6A and 6B.

Figure 5:
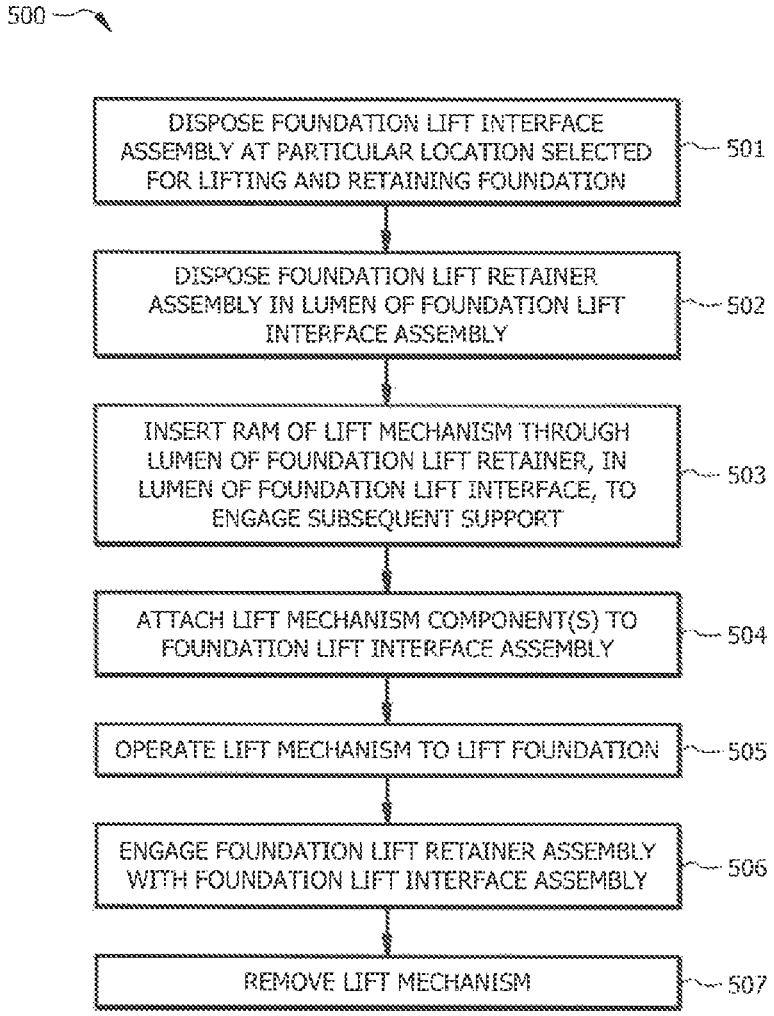
FIG. 5 shows a flow diagram for operation to lift and retain a foundation in a lifted position using a locking cap foundation retention system of embodiments of the present invention.

FIG. 5 shows example flow 500 for operation of foundation retention apparatuses using locking cap configurations according to embodiments of the invention to provide for sustaining a foundation in a lifted position. Operations of flow 500 may, for example, be implemented with respect to components of foundation lift interface assembly 110 (e.g., lift pull member 111 and lifting puck 112) and foundation lift retainer assembly 120 (e.g., locking cap 121 and lift support member 122) of locking cap foundation retention system 100, shown in FIG. 1, for supporting operations to lift a foundation into a desired position and sustaining the foundation in its lifted position for each instance of a foundation lift point. Accordingly, although operation in accordance with flow 500 is generally described below with reference to a single instance of a locking cap foundation retention system, it should be appreciated that any number (e.g., tens to over one hundred) of instances of locking cap foundation retention systems may be utilized (e.g., simultaneously) in retaining a lifted foundation in a lifted position in accordance with operation of flow 500.

At block 501 of the illustrated embodiment of flow 500, foundation lift interface assembly 110 of locking cap foundation retention system 100 is disposed at a selected location within the foundation to be lifted. For example, various locations may be selected round the periphery of the foundation as well as throughout the interior area of the foundation, such as by engineering analysis of the loads, spans, etc., to provide adequate support for the foundation.

Figure 6A:
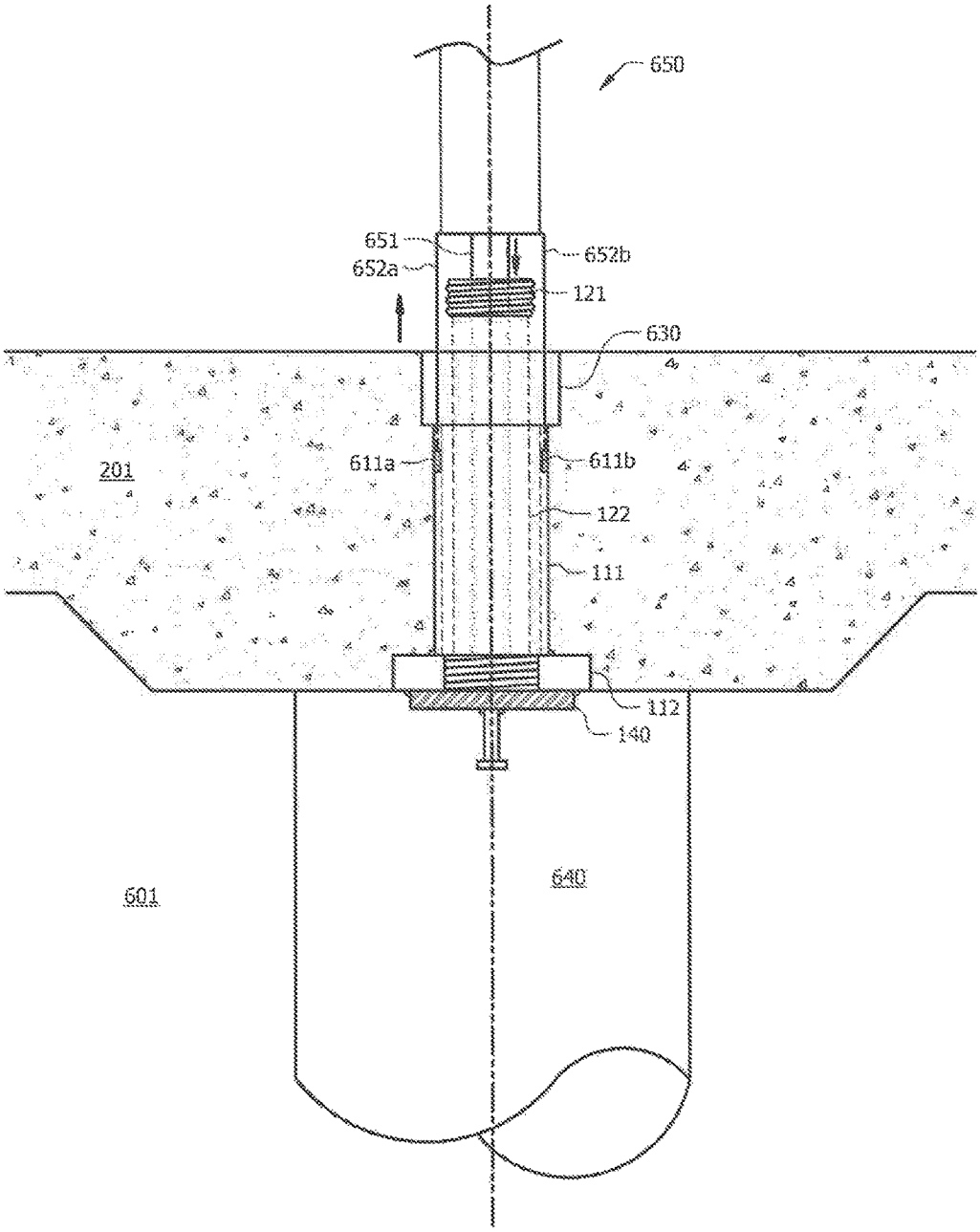
FIGS. 6A and 6B illustrate operation of a locking cap foundation retention system of embodiments of the present invention in lifting and retaining a lifted foundation in a lifted position.

It should be appreciated that positions selected for disposing instances of locking cap foundation retention system 100 are preferably prepared in advance in order to provide suitable subjacent support for lifting and retaining the foundation in a lifted position. For example, piers, pilings, footings, natural rock, and/or other subjacent support structure (e.g., concrete pier 640 having baseplate 140 embedded therein, as shown in FIG. 6A) may be prepared to receive instances of locking cap foundation retention system 100 at various locations of a ground surface (e.g., ground surface 601) in preparation for forming a foundation (e.g., foundation structure 201 to be lifted) thereon. Accordingly, as one example of disposing foundation lift interface assembly 110 at a selected location in accordance with block 501 of flow 500, foundation lift interface assembly 110 may be placed in juxtaposition with a corresponding instance of baseplate 140 embedded in concrete pier 640 previously prepared for providing suitable subjacent support.

Foundation lift interface assembly 110 of embodiments is preferably embedded in or otherwise engaged with a foundation structure prior to a lifting operation utilizing locking cap foundation retention system 100 in combination with removable lifting mechanisms. In an example of foundation lift interface assembly 110 embedded in a foundation, a poured concrete slab foundation may be formed with instances of foundation lift interface assembly 110 disposed therein. In accordance with embodiments of the invention, plug 130 may be disposed over the end of lift pull member 111 for displacing foundation media when the foundation structure is formed (e.g., concrete is poured), and removed thereafter to reveal a foundation media fill pocket (shown as pocket 630 in FIG. 6A) allowing access to foundation lift interface assembly 110. After the lifting operation and engaging the locking cap of foundation lift retainer assembly is complete, the foundation media fill pocket may be filled with foundation media or other material (e.g., to provide a filled surface flush with that of the top of foundation structure 201) to conceal the components of locking cap foundation retention system 100.

At block 502 of flow 500 illustrated in FIG. 5, foundation lift retainer assembly 120, or portions thereof, is disposed in lumen 211 and lumen 212 of foundation lift interface assembly 110. For example, lift support member 122 may be disposed to extend through lumen 211 of lift pull member 111 and lumen 122 of lifting puck 112 to rest upon baseplate 140. Depending upon the length of lift support member 122, and correspondingly the amount of lift to be sustained with respect to foundation structure 201, lift support member 122 and locking cap 121 thereon may or may not extend beyond the top surface of foundation structure 201. In the embodiment illustrated in FIG. 6A, lift support member 122 is of sufficient length to extend out of lumen 211 of lift pull member 111 and beyond the top surface of foundation structure 201, and thus locking cap 121 is initially disposed outside of lumen 211.

Having deployed the various components of locking cap foundation retention system 100 at a selected location for supporting operations to lift a foundation into a desired position and retaining the foundation in a lifted position, operation at blocks 503 and 504 of the illustrated embodiment of flow 500 provide for disposing a corresponding removable lift mechanism for use in lifting the foundation. For example, a removable lift mechanism, such as a hydraulic ram, is preferably used with locking cap foundation retention system 100 for lifting the foundation. Accordingly, in the embodiment of flow 500 illustrated in FIG. 5, a removable lift mechanism, or portions thereof, is disposed in lumen 321 and lumen 322 of foundation lift retainer assembly and lumen 211 and 212 of foundation lift interface assembly. For example, ram 651 of hydraulic lift actuator 650 (FIG. 6A) may be disposed to extend through lumen 321 of locking cap 121, lumen 322 of lift support member 122, wherein lift support member 122 is disposed extending through lumen 211 of lift pull member 111 and lumen 212 of lifting puck 112, to rest upon baseplate 140 in preparation for applying a lifting (push) force to the subjacent support for lifting a foundation. Correspondingly, in the embodiment of flow 500 illustrated in FIG. 5, the removable lift mechanism, or portions thereof, is attached to foundation lift interface assembly 110. For example, drawbars 652*a* and 652*b* of hydraulic lift actuator 650 (FIG. 6A) may be disposed to extend into lumen 211 of lift pull member 111 (e.g., between an inner surface of lift pull member 111 and an outer surface of lift support member 122) and be attached to lift pull member 111 for applying a lifting (pull) force to foundation lift interface assembly 110. Drawbars 652*a* and 652*b* may, for example have hooks, eyelets, etc. that releasably engage with a corresponding feature (e.g., attachment points 611*a* and 611*b*), such as may comprise a lip, protuberance, etc. disposed in or upon an inner surface of lift pull member 111. It should be appreciated that, although the illustrated embodiment shows a removable lift mechanism engaging with lift pull member 111 of foundation lift interface assembly 110, a removable lift mechanism may additionally or alternatively engage with lifting puck 112.

At block 505 of the illustrated embodiment of flow 500, the lift mechanism, having been deployed with respect to a corresponding instance of locking cap foundation retention system 100, is operated to lift the foundation. For example, hydraulic lift actuator 650 may be controlled to extend ram 651, whereby ram 651 applies a pushing force against baseplate 140 thereby lifting the body of hydraulic lift actuator 650. Drawbars 652*a* and 652*b*, attached to both the body of hydraulic lift actuator 650 and foundation lift interface assembly 110, thereby apply a pulling force against foundation lift interface assembly 110. Foundation lift interface assembly 110, embedded in or otherwise attached to foundation structure 201, transfers lifting forces to foundation structure 201 which is thus lifted in response to operation of hydraulic lift actuator 650. Accordingly, foundation structure 201 may be lifted off of ground surface 601 and void 602 (FIG. 6B) formed therebetween. It should be appreciated that a plurality of hydraulic lift actuators, similarly deployed with respect to corresponding instances of locking cap foundation retention system 100, may be simultaneously controlled (e.g., by one or a few workmen operating a hydraulic manifold control system or other suitable control system) to lift a slab.

In operation according to embodiments, components of foundation lift retainer assembly 120 are configured to move within lumen 211 and/or lumen 212 of foundation lift interface assembly 111 during the above described lifting operation. Accordingly, as foundation lift interface assembly 110, and correspondingly foundation structure 201, is lifted by hydraulic lift actuator 650, embodiments of foundation lift retainer assembly 120 may remain stationary with lift support member 122 resting on baseplate 140. Operation at block 505 of embodiments continues to control hydraulic lift actuator 650 to lift foundation structure 201 until the length of lift support member 122 is disposed below a bottom surface of lifting puck 112.

Figure 6B:
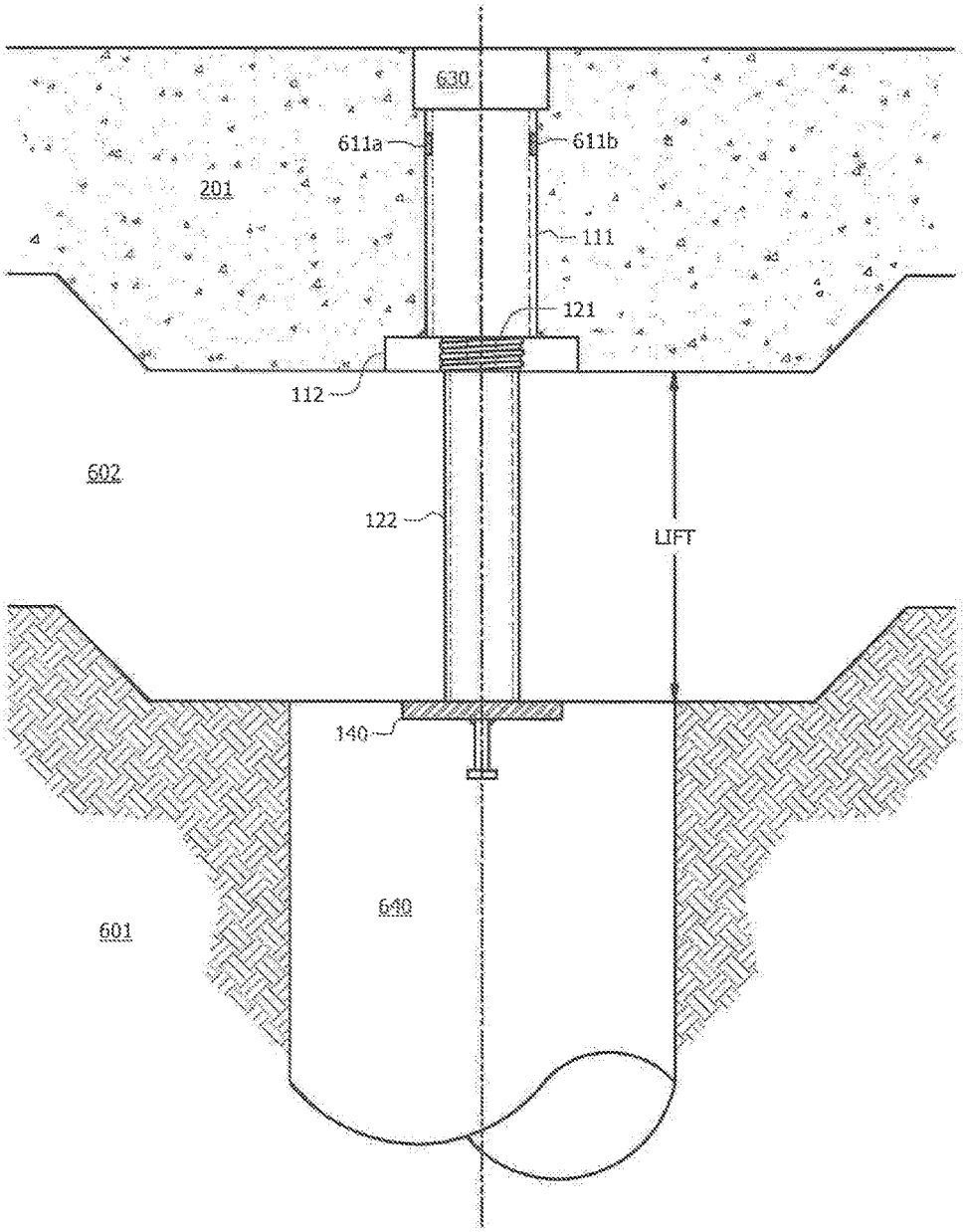

At block 506 of flow 500 illustrated in FIG. 5, after foundation lift interface assembly 110 has been lifted a sufficient amount (e.g., at least an amount of lift to be retained by lift support member 122, and possibly some amount of over-lift to facilitate manipulation of components of foundation lift retainer assembly 120, foundation lift retainer assembly 120 of embodiments is engaged with foundation lift interface assembly 110 for sustaining a desired amount of lift with respect to foundation structure 201. For example, rotational forces may be applied to locking cap 121 to engage threads, cam-lock tabs, etc. thereon with corresponding structure of lifting puck 112, whereby locking cap 121 is attached to lifting puck 112 to prevent further movement of locking cap 121 relative to lifting puck 112. Accordingly, hydraulic lift actuator 650 may be controlled to retract ram 651, whereby the lifting forces (e.g., pushing force against baseplate 140 applied by ram 651 and pulling force against foundation lift interface assembly 110 applied by drawbars 652*a* and 652*b*) are removed and weight of foundation structure 201, as transferred via lifting puck 112 and locking cap 121, is allowed to settle upon lift support member 122 as shown in FIG. 6B. Thus, foundation structure 201 is sustained in the lifted position by locking cap foundation retention system 100 of the illustrated embodiment, and hydraulic lift actuator 650 may be removed (e.g., for reuse in another foundation lifting operation) as shown in block 507 of the illustrated embodiment.

It should be appreciated from the foregoing that the amount of lift sustained by locking cap foundation retention system 100 of embodiments substantially corresponds to the length of lift support member 122 used. Accordingly, the lift provided and retained in accordance with embodiments of the invention may be controlled at least in part through selection of the length(s) of lift support members of a locking cap foundation retention system implementation. Although the amount of lift may correspond to the length of lift support members, embodiments of the present invention may provide additional (e.g., fine) control with respect to lift through locking cap and/or lifting puck configurations. For example, fine adjustment (e.g., depending on the thickness of the locking cap and/or lifting puck utilized) of an amount of lift retained by an implementation of locking cap foundation retention system 100 may be provided by threaded engagement of locking cap 121 in lifting puck 112. Rotational force may be applied to locking cap 121 to thread the locking cap into lifting puck 112 to a greater or lesser extent. Embodiments of locking cap 121 may be thicker than lifting puck 112, for example, in order to facilitate further adjustability as provided by such threaded configurations of locking cap 121 and lifting puck 112.

In some embodiments, locking cap foundation retention system 100 may be adjusted at a later time (e.g., months, years, etc.) to modify the amount of lift of a lifted foundation. For example, after five years of retaining foundation structure 201 in a lifted position using locking cap foundation retention system 100, hydraulic lift actuator 650 may be reattached to foundation lift interface assembly 110 and controlled to extend ram 651 through the lumens of the locking cap foundation retention system (e.g., lumen 211 of lift pull member 111 of FIG. 2A, lumen 212 of lifting puck 112 of FIG. 2B, lumen 321 of locking cap 121 of FIGS. 3B and 3C, and lumen 322 of lift support member 122 of FIG. 3A) and engage with baseplate 140 to support foundation structure 201 in the lifted position. With hydraulic lift actuator 650 supporting foundation structure 201 in the lifted position, locking cap 121 may be disengaged from lifting puck 112 and hydraulic lift actuator 650 may be controlled to lower foundation structure 201. Once lowered, the installed lift support member (e.g., a first lift support member 122) may be replaced with a replacement (e.g., shorter, longer, etc.) lift support member (e.g., a second lift support member 122) corresponding to an adjusted amount of lift (e.g., higher, lower, etc.) and foundation structure 201 may be lifted again in accordance with operations described above and retained in an adjusted lifted position with the replacement lift support member and locking cap 121 of foundation lift interface assembly 110. Additionally or alternatively, locking cap foundation retention system 100 may be statically locked after locking cap 121 and lifting puck 112 are engaged to retain foundation structure 201 in a lifted position. For example, curable media (e.g., grout, concrete, epoxy, etc.) may be poured into and/or reinforcements (e.g., rebar, etc.) installed within the lumens of the locking cap foundation retention system to enhance the strength (e.g., increased lateral and axial capacity resulting in reduced dimensions) and longevity (e.g., increased resistance to corrosion, component wear-and-tear, etc.) of the locking cap foundation retention system.

It should be appreciated that components of instances of locking cap lift system 100 may be configured (e.g., sized, shaped, etc.) in accordance with various factors (e.g., an amount of lift, weight of the completed structure to be supported, etc.) of the particular foundation lifting environment in which they are expected to be used. For example, as mentioned above, various amounts of lift may be provided according to embodiments of locking cap foundation retention system 100, and various dimensions of components of locking cap lift system 100 may be selected as a function of the amount of lift. The tables below provide details with respect to example configurations of components of locking cap lift system 100.

| | | Locking Cap | | | Lift Support Member | | |
|---|---|---|---|---|---|---|---|
| Lift | Weight of Structure | Diameter | Thickness | Lumen Diameter | Length | Outside Diameter | Inside Diameter |
| 1-10" | 35 Kips | 2.875" | 1.000" | 1.000" | 1-10" | 2.375" | 2.067" |
| 1-18" | 50 Kips | 3.250" | 1.125" | 1.000" | 1-18" | 2.875" | 1.771" |
| 1-36" | 55 Kips | 3.875" | 1.250" | 1.000" | 1-36" | 3.500" | 2.300" |

| | | Lift Pull Member | | | Lifting Puck | | |
|---|---|---|---|---|---|---|---|
| Lift | Weight of Structure | Length | Outside Diameter | Inside Diameter | Length | Width | Thickness |
| 1-10" | 35 Kips | 8" | 3.500" | 3.048" | 6.000" | 6.000" | 1.000" |
| 1-18" | 50 Kips | 8" | 4.000" | 3.548" | 6.500" | 6.500" | 1.125" |
| 1-36" | 55 Kips | 10" | 4.500" | 4.026" | 6.750" | 6.750" | 1.250" |

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A locking cap foundation retention system comprising:

a locking cap having a lumen therein configured to pass a component of a lifting mechanism therethrough during a lifting operation and allowing removal of the component of the lifting mechanism after the lifting operation;

a lift support member having a lumen therein configured to pass the component of the lifting mechanism therethrough during the lifting operation and allowing removal of the component of the lifting mechanism after the lifting operation, wherein the lift support member cooperates with the locking cap to retain a foundation structure in a lifted position after removal of the component of the lifting mechanism; and a lifting puck having a lumen therein configured to pass the lift support member therethrough during the lifting operation and to engage the locking cap for retaining the foundation structure in the lifted position after the lifting operation, wherein the lifting puck is configured to be embedded in the foundation structure and transfer a lifting force thereto during the lifting operation.

2. The system of claim 1, wherein the lift support member is configured to interface with subjacent support with respect to the foundation structure after the lifting operation to retain the foundation structure in the lifted position after the lifting operation when the locking cap is engaged with the lifting puck.

3. The system of claim 1, wherein the locking cap comprises at least one of threads or cam-lock tabs for engaging corresponding structure of the lifting puck.

4. The system of claim 1, wherein the lifting mechanism is removed from the locking cap and the lift support member after the lifting operation when the foundation structure is retained in the lifted position.

5. The system of claim 1, wherein the lifting mechanism comprises a hydraulic actuator and the component of the lifting mechanism comprises a hydraulic actuator ram.

6. The system of claim 1, wherein curable media is poured into the lumen of the lift support member and the lumen of the locking cap.

7. The system of claim 1, wherein an amount of lift retained with respect to the foundation structure is adjustable by rotating the locking cap with respect to the lifting puck.

8. The system of claim 7, wherein a length of the lift support member is selected to correspond to the amount of lift retained with respect to the foundation structure.

9. The system of claim 1, further comprising:

a lift pull member having a lumen disposed therein configured to pass both the locking cap and the lift support member therethrough during the lifting operation.

10. The system of claim 9, wherein the lift pull member is configured to be releasably attached to a lifting mechanism for transferring a lifting force to the foundation structure during the lifting operation.

11. A system for lifting a foundation structure and retaining the foundation structure in a lifted position, the system comprising:

a foundation lift interface assembly configured to interface with the foundation structure and transfer a lifting force thereto during a lifting operation, the foundation lift interface assembly having a lumen therein configured to pass a first component of a foundation lift retainer assembly therethrough during the lifting operation and to engage a second component of the foundation lift retainer assembly for retaining the foundation structure in the lifted position after the lifting operation, the foundation lift interface assembly further including a third component having the lumen disposed therein, wherein the third component comprises a lifting puck configured to be embedded in the foundation structure; and the foundation lift retainer assembly comprising the first component and the second component, wherein the first component of the foundation lift retainer assembly is configured to pass through the lumen of the foundation lift interface assembly to interface with subjacent support with respect to the foundation structure during the lifting operation and to cooperate with the second component of the foundation lift retainer assembly for retaining the foundation structure in the lifted position after the lifting operation, and wherein the second component of the foundation lift retainer assembly is configured to engage the foundation lift interface assembly for retaining the foundation structure in the lifted position after the lifting operation.

12. The system of claim 11, wherein the foundation lift interface assembly comprises a fourth component having a lumen disposed therein, wherein the lumen of the fourth component of the foundation lift interface assembly is configured to pass both the first component of the foundation lift retainer assembly and the second component of the foundation lift retainer assembly therethrough during the lifting operation, and wherein the lumen of the third component of the foundation lift interface assembly is configured to pass the first component of the foundation lift retainer assembly without passing the second component of the foundation lift retainer assembly during the lifting operation.

13. The system of claim 12, wherein the fourth component of the foundation lift interface assembly is configured to be releasably attached to components of a lifting mechanism for applying a lifting force to the foundation lift interface assembly during the lifting operation.

14. The system of claim 11, wherein the second component of the foundation lift retainer assembly comprises a locking cap configured to engage a component of the foundation lift interface assembly through application of rotational force.

15. The system of claim 14, wherein the locking cap comprises at least one of threads or cam-lock tabs for engaging corresponding structure of the lumen of the foundation lift interface assembly.

16. The system of claim 14, wherein an amount of lift retained with respect to the foundation structure is adjustable by rotating the locking cap.

17. The system of claim 16, wherein a length of the first component of the foundation lift retainer assembly is selected to correspond to the amount of lift retained with respect to the foundation structure.

18. The system of claim 14, wherein the locking cap has a lumen therein configured to pass a component of a lifting mechanism therethrough during the lifting operation.

19. The system of claim 18, wherein curable media is poured into the lumen of the foundation lift interface assembly and the lumen of the locking cap.

20. The system of claim 18, wherein the second component of the foundation lift retainer assembly comprises a lift support member, and wherein the lift support member has a lumen therein configured to pass the component of the lifting mechanism therethrough during the lifting operation.

21. The system of claim 20, wherein the lifting mechanism is removed from the locking cap and the lift support member after the lifting operation when the foundation structure is retained in the lifted position.

22. The system of claim 20, wherein the lifting mechanism comprises a hydraulic actuator and the component of the lifting mechanism comprises a hydraulic actuator ram.

23. A method for lifting a foundation structure and retaining the foundation structure in a lifted position, the method comprising:

disposing a foundation lift interface assembly in the foundation structure, wherein the foundation lift interface assembly includes a lifting puck configured to be embedded in the foundation structure and transfer a lifting force thereto during a lifting operation, the foundation lift interface assembly having a lumen therein; and disposing at least a portion of a foundation lift retainer assembly through the lumen of the foundation lift interface assembly for interfacing with subjacent support with respect to the foundation structure, the foundation lift retainer assembly having a lumen configured to pass a portion of a lifting mechanism therethrough during the lifting operation;

disposing at least the portion of the lifting mechanism through the lumen of the foundation lift retainer assembly to interface with the subjacent support for applying a pushing force thereto;

releasably attaching the lifting mechanism to the foundation lift interface assembly for applying a pulling force thereto;

controlling the lifting mechanism to lift the foundation structure and create a void between the foundation structure and a surface of the subjacent support;

engaging the foundation lift retainer assembly with the foundation lift interface assembly to retain the foundation structure in the lifted position; and remove the lifting mechanism from the foundation lift interface assembly and from within the foundation lift retainer assembly.

24. The method of claim 23, wherein the lifting mechanism comprises a hydraulic actuator and the portion of the lifting mechanism disposed through the lumen of the foundation lift retainer assembly comprises a hydraulic actuator ram.

25. The method of claim 23, further comprising:

pouring curable media into the lumen of the foundation lift interface assembly and the lumen of the foundation lift retainer assembly.

26. The method of claim 23, wherein the lumen of the foundation lift interface assembly is configured to pass a first component of a foundation lift retainer assembly therethrough during the lifting operation and to engage a second component of the foundation lift retainer assembly for retaining the foundation structure in the lifted position after the lifting operation.

27. The method of claim 26, wherein the first component of the foundation lift retainer assembly is configured to pass through the lumen of the foundation lift interface assembly to interface with the subjacent support with respect to the foundation structure and to cooperate with the second component of the foundation lift retainer assembly for retaining the foundation structure in the lifted position after the lifting operation, and wherein the second component of the foundation lift retainer assembly is configured to engage the foundation lift interface assembly to for retaining the foundation structure in the lifted position after the lifting operation.

28. The method of claim 26, wherein the second component of the foundation lift retainer assembly comprises a locking cap configured to engage a component of the foundation lift interface assembly through application of rotational force.

29. The method of claim 28, further comprising:

adjusting an amount of lift retained with respect to the foundation structure by rotating the locking cap.

* * * * *